US008453587B2

(12) United States Patent
Bagley

(10) Patent No.: US 8,453,587 B2
(45) Date of Patent: Jun. 4, 2013

(54) CONCENTRIC HOPPING FOOT FOR SEWING MACHINE

(75) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 0 days.

(21) Appl. No.: 13/290,407

(22) Filed: Nov. 7, 2011

(65) Prior Publication Data

US 2013/0112128 A1 May 9, 2013

(51) Int. Cl.
*D05B 29/00* (2006.01)

(52) U.S. Cl.
USPC ..... 112/237

(58) Field of Classification Search
USPC ..... 112/237, 245, 236, 238, 239, 240
See application file for complete search history.

(56) References Cited

U.S. PATENT DOCUMENTS

| | | | | |
|---|---|---|---|---|
| 4,292,907 | A | 10/1981 | Gilbride et al. | |
| 4,403,561 | A * | 9/1983 | Schaeflern et al. | 112/237 |
| 4,495,876 | A * | 1/1985 | Tajima | 112/102.5 |
| 4,498,407 | A * | 2/1985 | Landwehr et al. | 112/308 |
| 5,564,355 | A | 10/1996 | Watson | |
| 6,520,101 | B2 * | 2/2003 | Sano et al. | 112/237 |
| 7,717,050 | B2 | 5/2010 | Park | |

* cited by examiner

*Primary Examiner* — Tejash Patel
(74) *Attorney, Agent, or Firm* — J. David Nelson

(57) ABSTRACT

A sewing machine hopping foot assembly having a hopping foot which has a hopping foot top with a hopping foot needle bar opening, a hopping foot base with a hopping foot base opening, and one or more hopping foot arms connecting the hopping foot top to the hopping foot base, having a hopping foot bushing with an interior annular space, the hopping foot bushing being connected to the hopping foot, the annular space providing for a normal up and down sewing movement of the needle bar in the annular space.

16 Claims, 6 Drawing Sheets

CONCENTRIC HOPPING FOOT FOR SEWING MACHINE

FIELD OF THE INVENTION

This invention is in the field of sewing machines and in particular in the field of hopping feet for industrial, commercial and individual sewing machines.

BACKGROUND OF THE INVENTION

A typical sewing machine has three principal components which contact the fabric that is being sewn, namely the throat base, the hopping foot and the needle. The fabric rests upon and is positioned by the throat base, which is a horizontal flat surface having a penetration which allows the needle to push completely through the bottom of the fabric that is being sewn and interact with a bobbin is beneath the throat base, and which, with the needle, provides for completion of the stitching operation. The needle, with thread fed in a controlled fashion by other components of the sewing machine, performs the stitching operation through interaction with the bobbin beneath the throat base. The hopping foot presses down on top of the fabric keeping the fabric positioned on the throat base and preventing separation and relative movement of the layers of fabric that are being sewn. A hopping foot is typically spring loaded, providing for fabric thickness variations and progression of the fabric as it is being sewn. The needle is secured by and driven by a needle bar which is attached to and controlled by the needle drive system of the sewing machine.

A hopping foot is normally positioned either behind the needle bar, that is between the operator and the needle bar, or laterally from the needle bar, that is into the throat of the sewing machine. The throat of the sewing machine is the space between the needle bar and the vertical structure of the sewing machine. The dimensions of the throat are particularly important in sewing operations such as quilting, as it determines how much fabric can be positioned in the throat and therefore how far laterally into the fabric the sewing operation can progress.

There are several problems or limitations with traditional hopping foot design with the hopping foot being positioned either behind or laterally from the needle bar. Either the hopping foot imposes limitations on the visibility of the needle bar in the sewing operation, or it reduces the throat space of the sewing machine by reducing the usable throat width by the separation distance between the needle bar and the hopping foot. For the latter, this is typically approximately one inch. As indicated above, the width of the throat of a sewing machine that is available for fabric accumulation is particularly important for machine quilting, because, as a quilt is sewn, the sewn area of the quilt is rolled on a rail which passes through the throat of the sewing machine. Therefore, a sewing machine with more available throat width provides for an accumulation of a greater amount of fabric.

It is therefore an object of the present invention to provide a hopping foot that provides better visibility of a needle bar during fabric placement and sewing.

It is a further object of the present invention to provide a hopping foot that provides for increased throat space for the accumulation of fabric.

SUMMARY OF THE INVENTION

The traditional sewing machine shown has a laterally displaced hopping foot, extending from the needle bar into the throat of the sewing machine. For this version of a traditional sewing machine the hopping foot positioning reduces the available fabric accumulation area in the throat. Other versions of a traditional sewing machine have a rear displaced hopping foot, with the hopping foot positioned behind the needle bar, that is between the operator and the needle bar, which limits visibility of the bar and the needle by the operator.

A preferred embodiment of a hopping foot assembly of the present invention includes a hopping foot, hopping foot bushing, bushing lock nut, bushing spring, bushing spring base ring, spring fork assembly, bushing swing arm, a bushing top seal ring and bushing sleeve. The bushing lock nut may control the extent of the threading of the hopping foot onto the hopping foot bushing and stabilize the hopping foot orientation. This allows the operator to select the hopping foot orientation that is preferred by the operator.

The hopping foot bushing extends through a hopping foot top bushing opening in the machine jaw base. The bushing is protected from wear and tear and damage during its normal up and down movement by a bushing sleeve. The bushing spring base ring is secured to the hopping foot bushing outer surface. The bushing spring rests on the bushing spring base ring top and the spring upward movement is limited by the spring fork assembly. The spring fork assembly has a spring fork assembly base which, for a preferred embodiment, is a spring fork base. The bushing spring is confined between the spring retainer ring and the spring fork. The bushing spring maintains a downward force on the hopping foot bushing and the hopping foot at all times as the hopping foot and the hopping foot bushing move up and down due to variations in the thickness of the fabric being sewed. The hopping foot bushing swing arm stabilizes the lateral positioning of the hopping foot bushing and the hopping foot as the hopping foot and the hopping foot bushing experience the normal up and down movement.

The hopping foot bushing may be tubular with a circular cross section and a uniform wall thickness. Typically, the needle bar will also have a circular cross section and will pass through the annular space in the hopping foot bushing from the bushing top through the hopping foot bushing bottom and hopping foot needle bar opening in the hopping foot top.

The normal up and down needle tip movement of the needle tip in normal sewing operation is permitted by the hopping foot base opening in the hopping foot base. The hopping foot needle bar opening and the hopping foot base opening are approximately vertically alined. For a preferred embodiment of the hopping foot, a pair of hopping foot arms attach the hopping foot top to the hopping foot base, and the hopping foot throat width, the horizontal separation between the two hopping foot arms, provides for access by the operator to the needle for threading, needle replacement and the like. An alternative preferred embodiment of the hopping foot has only one hopping foot arm, which provides even greater access and visibility than the two hopping foot arm embodiment.

DETAILED DESCRIPTION OF PREFERRED EMBODIMENTS

Figure 1:
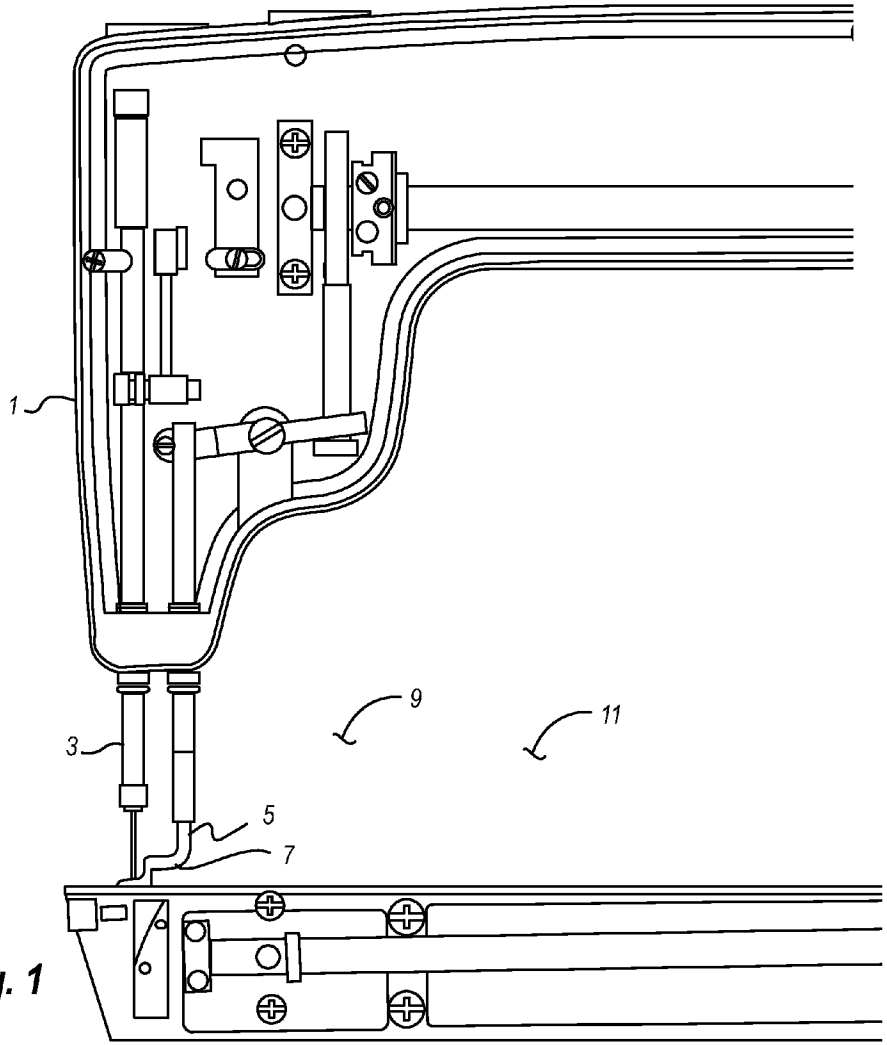
FIG. 1 is a side cutaway view of a traditional sewing machine with a traditionally designed and placed needle bar and hopping foot.

Referring first to FIG. 1, a side cutaway view of a traditional sewing machine 1 with a traditionally designed and placed needle bar 3 and hopping foot 5 is illustrated. The traditional sewing machine shown has a laterally displaced hopping foot 7, extending from the needle bar 3 into the throat 9 of the sewing machine. For this version of a traditional sewing machine the hopping foot positioning reduces the available fabric accumulation area 11 in the throat.

Other versions of a traditional sewing machine have a rear displaced hopping foot, with the hopping foot positioned behind the needle bar, that is between the operator and the needle bar. This version of a traditional sewing machine limits visibility of the bar and the needle by the operator.

Figure 2:
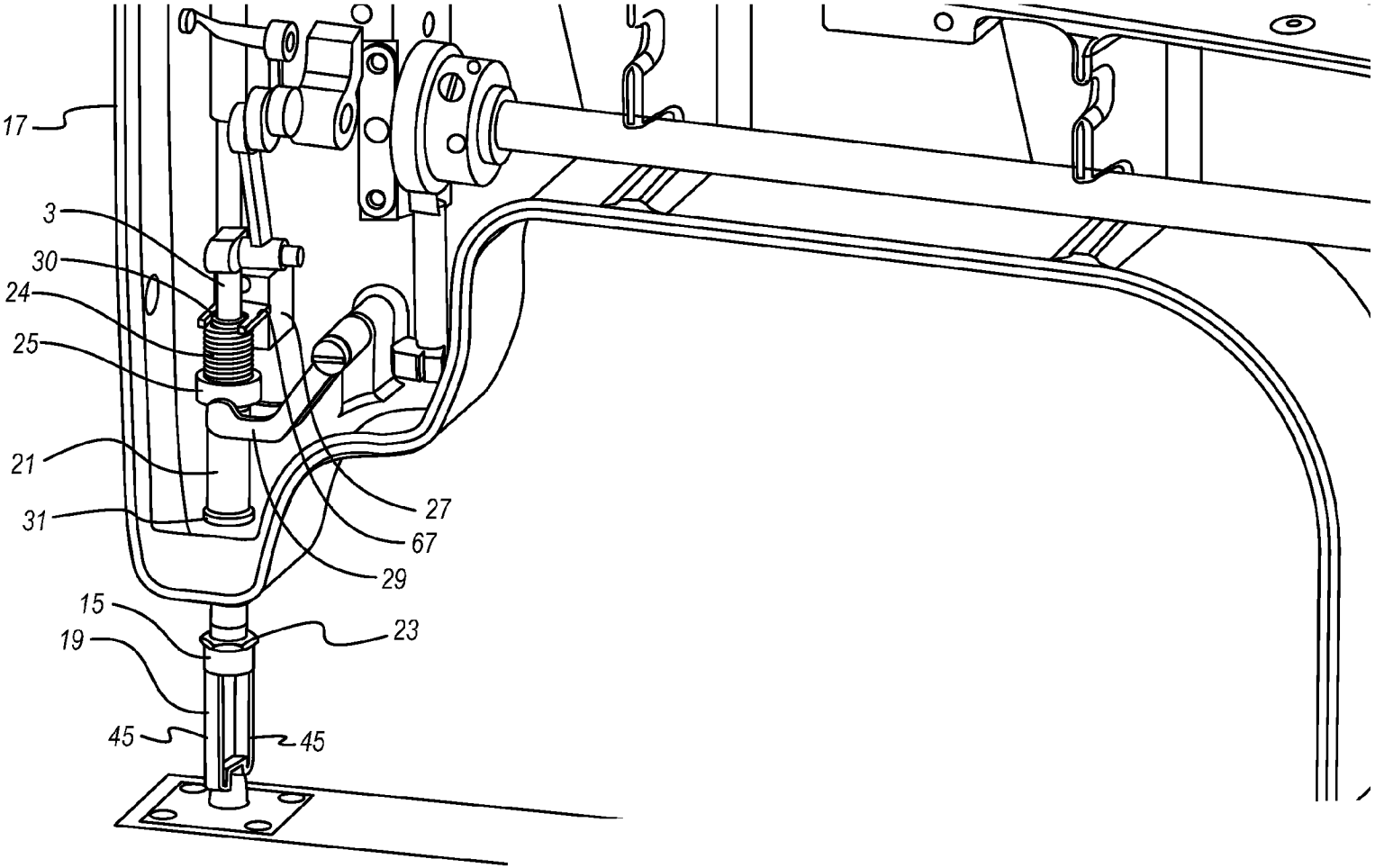
FIG. 2 is a side perspective cutaway view of a preferred embodiment of a hopping foot assembly of the present invention as deployed on a typical sewing machine.
Figure 3:
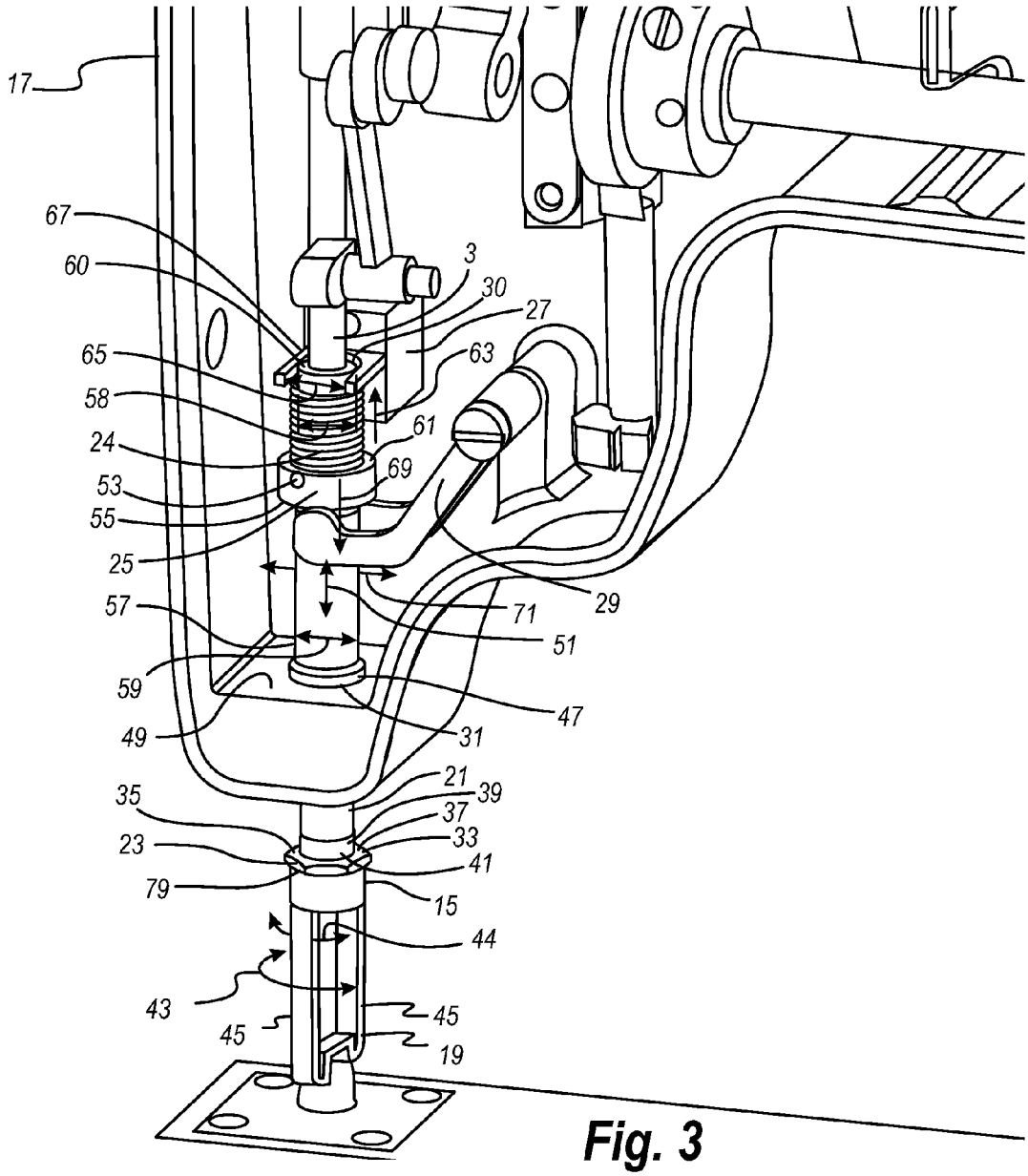
FIG. 3 is a top perspective cutaway detail view of a preferred embodiment of a hopping foot assembly of the present invention as deployed on a typical sewing machine.

Referring now to FIG. 2, a preferred embodiment of a hopping foot assembly 15 of the present invention is shown, as deployed on a typical sewing machine 17. Referring also to FIG. 3, the hopping foot assembly 15, for the embodiment shown, includes a hopping foot 19, hopping foot bushing 21, bushing lock nut 23, bushing spring 24, bushing spring base ring 25, spring fork assembly 27, bushing swing arm 29, a bushing top seal ring 30 and bushing sleeve 31. For the embodiment shown female threads 33 in the hopping foot top 35 meet with male threads 37 on the hopping foot bushing bottom 39. The bushing lock nut 23 controls the extent of the threading 41 of the hopping foot 19 onto the hopping foot bushing 21 and stabilizes the hopping foot orientation 43. Through use of the bushing lock nut 23, the hopping foot orientation 43 and thus the arm positioning 44 of the hopping foot arms 45 can be adjusted and stabilized by the operator. This allows the operator to select the hopping foot orientation 43 that is preferred by the operator. Other hopping foot connections 82 and devices for attaching the hopping foot 19 to the hopping foot bushing 21 and for providing for the operator to adjust and fix the hopping foot orientation 43 will be apparent to persons of ordinary skill in the art in view of the description presented in this specification and the drawings. Simplified embodiments may provide for the hopping foot orientation to be fixed and non-adjustable by the operator.

Figure 5:
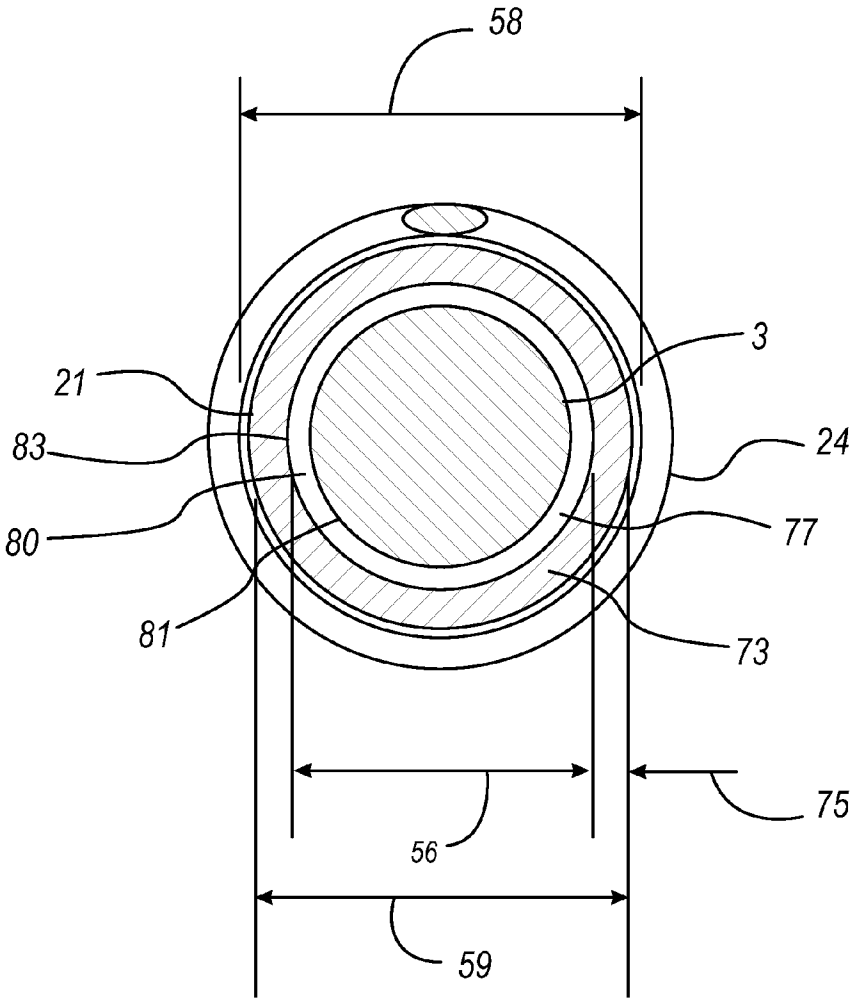
FIG. 5 is a horizontal cross-section, below the spring fork, of the needle bar, the hopping foot bushing, and the bushing spring of a preferred embodiment of the present invention.

The hopping foot bushing 21 extends through the hopping foot top bushing opening 47 in the machine jaw base 49. The bushing is protected from wear and tear and damage during its normal up and down movement 51 by the bushing sleeve 31. The bushing spring base ring 25 may be secured to the hopping foot bushing 21 by set screws 53 which mate with recesses 55 in the bushing outer surface 57. Referring also to FIG. 5, which is a horizontal cross-section, below the spring fork 67, of the needle bar 3, the hopping foot bushing 21, and the bushing spring 24, the bushing spring has an internal diameter 58 which is just slightly greater than the bushing external diameter 59 near the bushing top 60. The bushing spring 24 rests on the bushing spring base ring top 61 and the spring upward movement 63 is limited by the spring fork assembly 27. The spring fork assembly 27 has a spring fork assembly base 28, which, for the embodiment shown, is a spring fork base 30. The fork jaw width 65 of the spring fork 67 is slightly greater than the bushing top diameter 59. The bushing spring 24 is therefore confined between the spring retainer ring 25 and the spring fork 67. The bushing spring maintains a downward force 69 on the hopping foot bushing 21 and the hopping foot 19 at all times as the hopping foot 19 and the hopping foot bushing 21 move up and down due to variations in the thickness of the fabric being sewed. The hopping foot bushing swing arm 29 stabilizes the lateral positioning 71 of the hopping foot bushing 21 and the hopping foot 19 as the hopping foot 19 and the hopping foot bushing 21 experience the normal up and down movement 51.

As illustrated in FIG. 3 and FIG. 5, for the preferred embodiments shown the hopping foot bushing 21 is tubular with a circular cross section 73 and a uniform wall thickness 75. Typically, the needle bar 3 will also have a circular cross section and will pass through the annular space 77 in the hopping foot bushing 21 from the bushing top 60 through the hopping foot bushing bottom 39 and hopping foot needle bar opening 79 in the hopping foot top 35. The needle bar clearance 80 is maintained between the needle bar exterior surface 81 and the bushing interior surface 83 by the bushing top seal ring 30. The bushing top seal ring 30 is also intended to reduce or eliminate the intrusion of foreign substances in the annular space 77 between the bushing interior surface 83 and the needle rod exterior surface 81.

Figure 4:
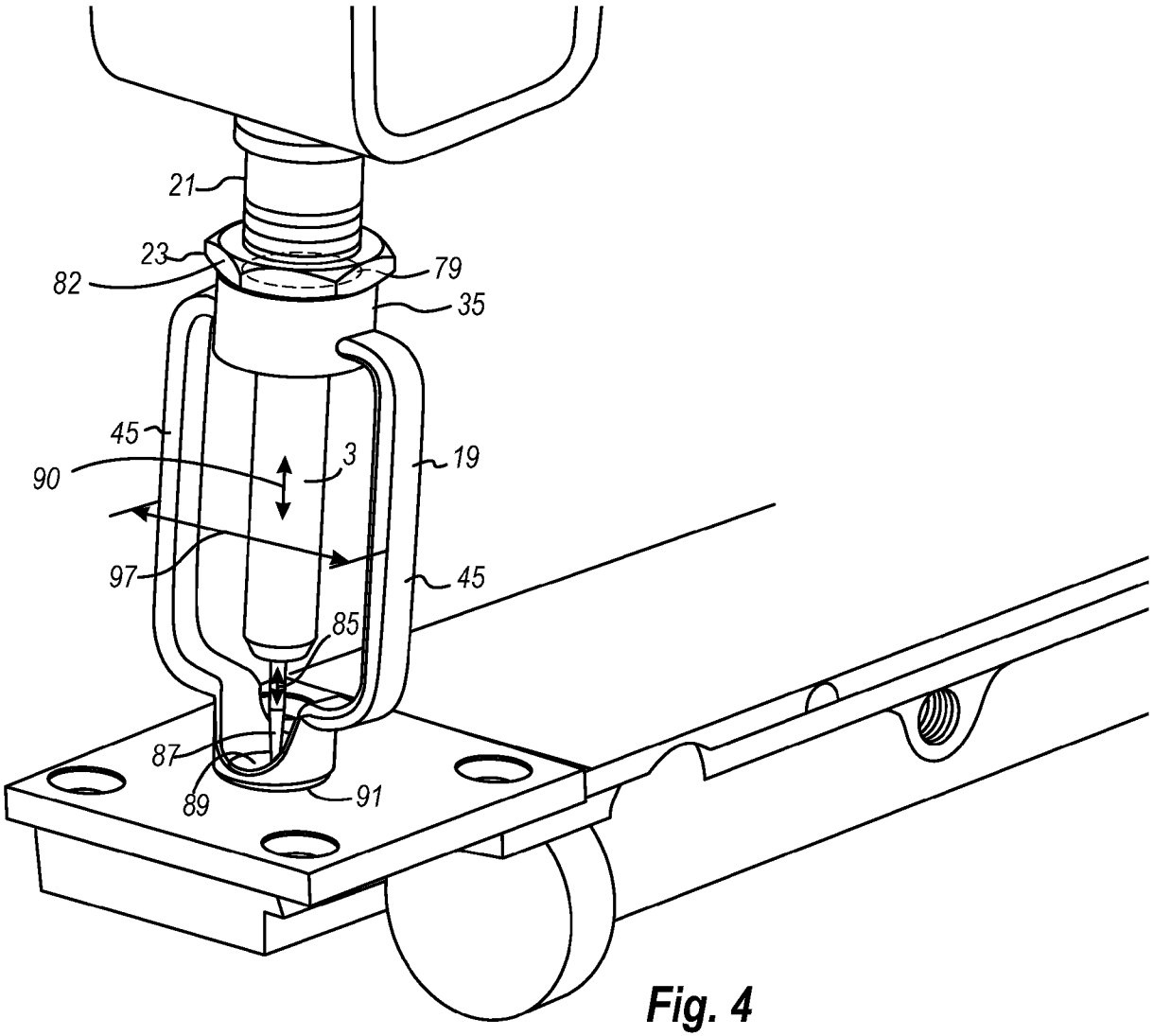
FIG. 4 is a perspective detail of a preferred embodiment of the hopping foot of the present invention having two hopping foot arms.
Figure 6:
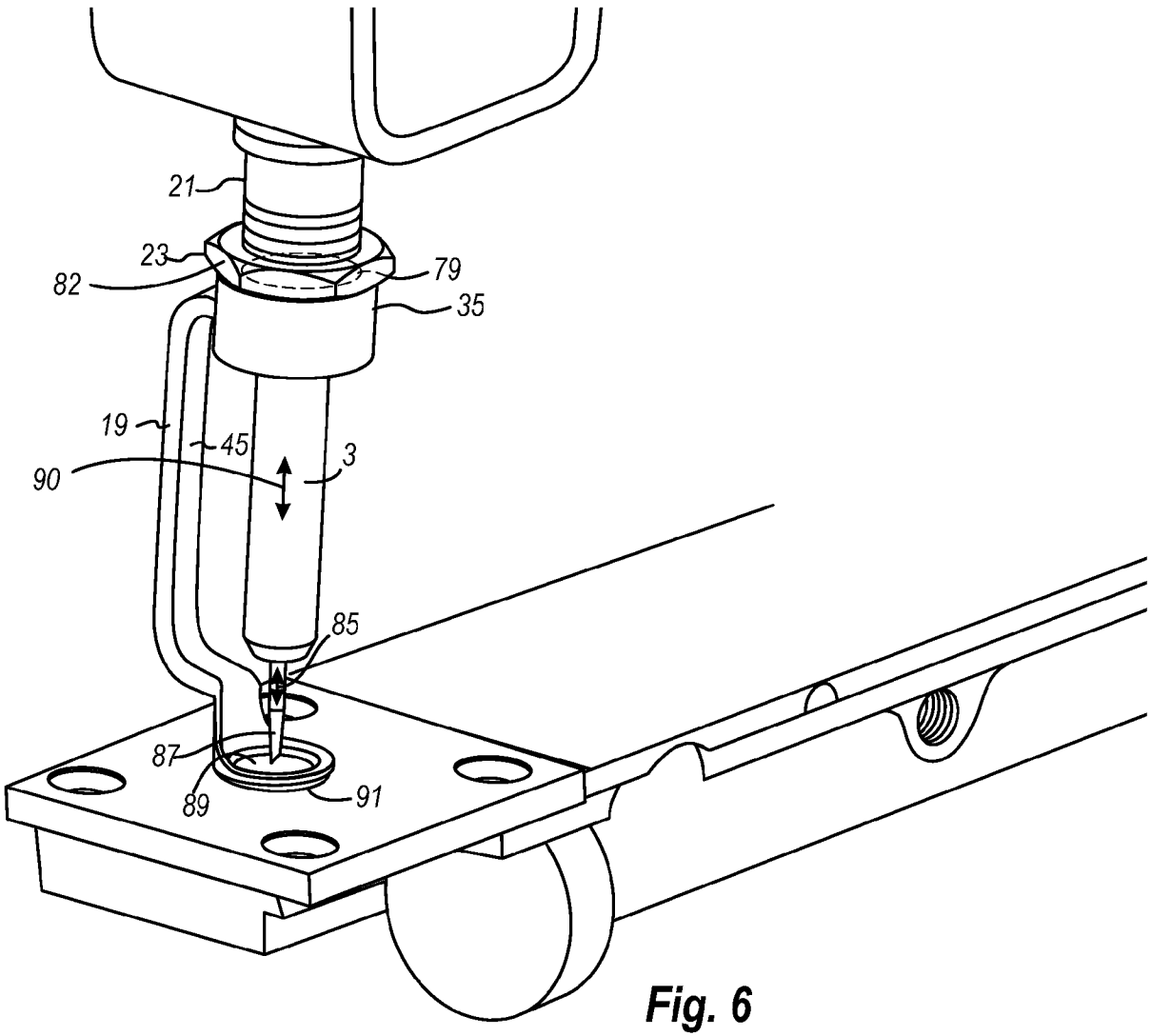
FIG. 6 is a perspective detail of a preferred embodiment of the hopping foot of the present invention having one hopping foot arm.

Referring also to FIG. 4, which is a perspective detail of a preferred embodiment of the hopping foot 19 of the present invention, the normal up and down needle tip movement 85 of the needle tip 87 in normal sewing operation is permitted by the hopping foot base opening 89 in the hopping foot base 91. For the preferred embodiment shown, the hopping foot needle bar opening 79 and the hopping foot base opening 89 are approximately vertically alined 90. For the embodiment of the hopping foot shown, a pair of hopping foot arms 45 attach the hopping foot top 35 to the hopping foot base 91, and the hopping foot throat width 97, the horizontal separation between the two hopping foot arms, provides for access by the operator to the needle for threading, needle replacement and the like. An alternative preferred embodiment of the hopping foot has only one hopping foot arm 45 attaching the hopping foot top 35 to the hopping foot base 91 as shown in FIG. 6. This alternative embodiment provides even greater access and visibility than the two hopping foot arm embodiment shown in FIG. 4.

While the use of a uniform diameter, uniform wall thickness, circular cross section tubing is preferred for the hopping foot bushing, other variations may provide for passing the needle rod to the hopping foot, while allowing and stabilizing the normal up and down operation of the hopping foot and the normal up and down operation of the needle bar will be obvious to persons of ordinary skill in the art, in view of the preferred embodiment described in this specification and the drawings. Likewise, other devices for positioning and retaining the bushing spring for the normal reciprocating motion of the hopping foot and the hopping foot bushing will be obvious to persons of ordinary skill in the art, in view of the description presented in this specification and the drawings. Further, other devices for attaching the hopping foot to the hopping foot bushing and for controlling the extent of the engagement of the bushing bottom and hopping foot top, as well as controlling the orientation of the hopping foot will likewise be obvious to persons of ordinary skill in the art in view of the description and the drawings contained herein. Still further, other devices for maintaining the lateral positioning of the hopping foot bushing and thus the hopping foot with respect to the needle bar, other than the bushing swing arm will also be obvious to persons of ordinary skill in the art, in view of the description presented in this specification and the drawings. Still further, other reciprocating assemblies for positioning and retaining the relative positions of the hopping foot bushing and the needle bar and providing for the reciprocating motion of the hopping foot and the hopping foot bushing, other than the bushing spring, bushing spring base ring, spring fork assembly, and bushing swing arm will be obvious to persons of ordinary skill in the are, in view of the description presented in this specification and the drawings. Still further, other variations in the features and components of the hopping foot assembly of the present invention will be obvious to persons of ordinary skill in the art in view of the description presented in this specification and the drawings.

Other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A hopping foot assembly for a sewing machine, the sewing machine having a sewing machine body and a needle bar, the hopping foot assembly comprising:

a hopping foot having a hopping foot top with a hopping foot needle bar opening, a closed loop hopping foot base with a hopping foot base opening extending through the hopping foot base, and one or more hopping foot arms, the hopping foot base being connected to the hopping foot top by the one or more hopping foot arms;

a hopping foot bushing having a hopping foot bushing exterior surface, a hopping foot bushing bottom, an approximately vertical interior annular space, and a concentric bushing spring base ring, the hopping foot bushing bottom being connected to the hopping foot top, the annular space dimensioned to provide for a normal up and down sewing movement of the needle bar in the annular space, and the concentric bushing spring base ring being affixed to the hopping foot exterior surface;

a bushing spring fitted concentrically to and adjacent to the hopping foot bushing exterior surface, the bushing spring having a bushing spring top and a bushing spring base, the bushing spring base resting upon the bushing spring base ring; and a spring fork assembly anchored to the sewing machine body, the spring fork assembly having a spring fork assembly base, the bushing spring top being fitted beneath the spring fork assembly base.

2. The hopping foot assembly recited in claim 1 wherein the hopping foot needle bar opening and the hopping foot base opening provide for the normal up and down sewing movement of a needle bar through the hopping foot needle bar opening and a normal up and down movement of the a needle through the hopping foot base opening.

3. The hopping foot assembly recited in claim 1 wherein the hopping foot needle bar opening and the hopping foot base opening are approximately vertically alined and are dimensioned to provide for the normal up and down sewing movement of a needle bar through the hopping foot needle bar opening and a normal up and down movement of the a needle through the hopping foot base opening.

4. The hopping foot assembly recited in claim 1 wherein the spring fork assembly comprises a spring fork, the spring fork having a spring fork base, and the bushing spring top being fitted beneath the spring fork base.

5. The hopping foot assembly recited in claim 1 wherein the downward movement of the bushing spring with respect to the hopping foot bushing is limited by the bushing spring base ring.

6. The hopping foot assembly recited in claim 1 wherein the upward movement of the bushing spring with respect to the hopping foot is limited by the spring fork assembly and wherein the spring fork assembly provides for the bushing spring to impose a downward force on the hopping foot bushing and the hopping foot during the normal sewing operation.

7. The hopping foot assembly recited in claim 1 further comprising a hopping foot connection between the hopping foot bushing and the hopping foot which provides for an operator to orient the hopping foot as desired by the operator and to fix the orientation of the hopping foot.

8. A hopping foot assembly for a sewing machine, the sewing machine having a sewing machine body and a needle bar, the hopping foot assembly comprising:

a hopping foot having a hopping foot top with a hopping foot needle bar opening, a closed loop hopping foot base with a hopping foot base opening extending through the hopping foot base, and one or more hopping foot arms, the hopping foot base being connected to the hopping foot top by the one or more hopping foot arms;

a hopping foot bushing having a hopping foot bushing exterior surface, a hopping foot bushing bottom, and an approximately vertical interior annular space, the hopping foot bushing bottom being connected to the hopping foot top, the annular space dimensioned to provide for a normal up and down sewing movement of the needle bar in the annular space; and a reciprocating assembly for positioning and retaining the relative positions of the hopping foot bushing and the needle bar and providing for the reciprocating motion of the hopping foot and the hopping foot bushing.

9. A hopping foot assembly for a sewing machine, the sewing machine having a sewing machine body and a needle bar, the hopping foot assembly comprising:

a hopping foot having a hopping foot top with a hopping foot needle bar opening, a peripherally partially open loop hopping foot base with a hopping foot base opening extending through the hopping foot base, the hopping foot base having a peripheral opening forming the peripherally partially open hopping foot base, and one or more hopping foot arms, the hopping foot base being connected to the hopping foot top by the one or more hopping foot arms;

a hopping foot bushing having a hopping foot bushing exterior surface, a hopping foot bushing bottom, an approximately vertical interior annular space, and a concentric bushing spring base ring, the hopping foot bushing bottom being connected to the hopping foot top, the annular space dimensioned to provide for a normal up and down sewing movement of the needle bar in the annular space, and the concentric bushing spring base ring being affixed to the hopping foot exterior surface;

a bushing spring fitted concentrically to and adjacent to the hopping foot bushing exterior surface, the bushing spring having a bushing spring top and a bushing spring base, the bushing spring base resting upon the bushing spring base ring; and a spring fork assembly anchored to the sewing machine body, the spring fork assembly having a spring fork assembly base, the bushing spring top being fitted beneath the spring fork assembly base.

10. The hopping foot assembly recited in claim 1 wherein the hopping foot needle bar opening and the hopping foot base opening provide for the normal up and down sewing movement of a needle bar through the hopping foot needle bar opening and a normal up and down movement of the a needle through the hopping foot base opening.

11. The hopping foot assembly recited in claim 1 wherein the hopping foot needle bar opening and the hopping foot base opening are approximately vertically alined and are dimensioned to provide for the normal up and down sewing movement of a needle bar through the hopping foot needle bar opening and a normal up and down movement of the a needle through the hopping foot base opening.

12. The hopping foot assembly recited in claim 1 wherein the spring fork assembly comprises a spring fork, the spring fork having a spring fork base, and the bushing spring top being fitted beneath the spring fork base.

13. The hopping foot assembly recited in claim 1 wherein the downward movement of the bushing spring with respect to the hopping foot bushing is limited by the bushing spring base ring.

14. The hopping foot assembly recited in claim 1 wherein the upward movement of the bushing spring with respect to the hopping foot is limited by the spring fork assembly and wherein the spring fork assembly provides for the bushing spring to impose a downward force on the hopping foot bushing and the hopping foot during the normal sewing operation.

15. The hopping foot assembly recited in claim 1 further comprising a hopping foot connection between the hopping foot bushing and the hopping foot which provides for an operator to orient the hopping foot as desired by the operator and to fix the orientation of the hopping foot.

16. A hopping foot assembly for a sewing machine, the sewing machine having a sewing machine body and a needle bar, the hopping foot assembly comprising:

a hopping foot having a hopping foot top with a hopping foot needle bar opening, a peripherally partially open loop hopping foot base with a hopping foot base opening extending through the hopping foot base, the hopping foot base having a peripheral opening forming the peripherally partially open hopping foot base, and one or more hopping foot arms, the hopping foot base being connected to the hopping foot top by the one or more hopping foot arms;

a hopping foot bushing having a hopping foot bushing exterior surface, a hopping foot bushing bottom, and an approximately vertical interior annular space, the hopping foot bushing bottom being connected to the hopping foot top, the annular space dimensioned to provide for a normal up and down sewing movement of the needle bar in the annular space; and a reciprocating assembly for positioning and retaining the relative positions of the hopping foot bushing and the needle bar and providing for the reciprocating motion of the hopping foot and the hopping foot bushing.

* * * * *